US008708477B2

(12) United States Patent
Ihara

(10) Patent No.: US 8,708,477 B2
(45) **Date of Patent: *Apr. 29, 2014**

(54) LIQUID EJECTING APPARATUS

(75) Inventor: Seiji Ihara, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/477,867

(22) Filed: May 22, 2012

(65) Prior Publication Data

US 2012/0229582 A1 Sep. 13, 2012

Related U.S. Application Data

(63) Continuation of application No. 12/730,955, filed on Mar. 24, 2010, now Pat. No. 8,201,936.

(30) Foreign Application Priority Data

Mar. 26, 2009 (JP) ..... 2009-075928

(51) Int. Cl.
*B41J 2/01* (2006.01)

(52) U.S. Cl.
USPC ..... 347/102

(58) Field of Classification Search
USPC ..... 347/102
See application file for complete search history.

(56) References Cited

U.S. PATENT DOCUMENTS

| | | | | |
|---|---|---|---|---|
| 5,831,655 | A | 11/1998 | Asawa | |
| 6,340,225 | B1 * | 1/2002 | Szlucha | 347/102 |
| 7,086,727 | B2 * | 8/2006 | Nishikawa et al. | 347/102 |
| 2007/0019050 | A1 | 1/2007 | Lim | |

FOREIGN PATENT DOCUMENTS

| | | |
|---|---|---|
| JP | 05-031893 | 2/1993 |
| JP | 2001-334647 | 12/2001 |
| JP | 2004-142166 | 5/2004 |
| JP | 2004-223962 | 8/2004 |

OTHER PUBLICATIONS

U.S. Appl. No. 12/730,955, Feb. 21, 2012, Notice of Allowance.

* cited by examiner

*Primary Examiner* — Julian Huffman
(74) *Attorney, Agent, or Firm* — Workman Nydegger

(57) ABSTRACT

A liquid ejecting apparatus includes: a liquid ejecting head having a nozzle opening for ejecting a liquid; a heating unit disposed opposite a liquid ejecting surface of the liquid ejecting head; a transport unit that transports a liquid-ejection-target medium between the liquid ejecting head and the heating unit; a blower unit that blows air onto a liquid-ejection-target surface of the medium; and a blowing control unit. The blower unit is able to vary an amount of air blown in a plurality of regions disposed along a certain direction, the plurality of regions including a region of the liquid-ejection-target medium, and the blowing control unit controls an amount of the air blown from the blower unit in the plurality of the regions along the certain direction on the basis of a width of the medium in the certain direction.

5 Claims, 10 Drawing Sheets

LIQUID EJECTING APPARATUS

This application is a Continuation of U.S. patent application Ser. No. 12/730,955 filed on Mar. 24, 2010 which claims priority to Japanese Patent Application No. 2009-075928, filed Mar. 26, 2009 which are expressly incorporated herein by reference.

BACKGROUND

1. Technical Field

The present invention relates to a liquid ejecting apparatus including a liquid ejecting head for ejecting a liquid onto a liquid-ejection-target medium.

2. Related Art

An ink jet recording apparatus such as an ink jet printer or a plotter has an ink jet recording head which is capable of ejecting ink as an ink droplet, the ink being stored in a storage unit such as an ink cartridge or an ink tank.

The ink jet recording head has a pressure generating chamber that is in communication with a nozzle opening and a pressure generating unit for generating a pressure change in the pressure generating chamber to eject an ink droplet from the nozzle opening. Examples of the pressure generating unit mounted on the ink jet recording head include a longitudinal vibration type piezoelectric device, a flexural vibration type piezoelectric device, a heat generating device, and a unit using electrostatic force.

In JP-A-2004-223962 and JP-A-5-31893, ink jet recording apparatuses are proposed in which a heating unit such as a heater heats a platen to dry ink ejected onto a recording sheet.

In JP-A-2004-142166, an ink jet recording apparatus is proposed, which is provided with a blower unit for blowing air onto a surface of a recording sheet on which printing has been performed.

In cases where a heating unit is provided in order to dry ink, the ink jet recording head is heated by the heat produced by the heating unit, so that a volatile component of ink in the vicinity of the nozzle opening is evaporated. Thereby, viscosity of the ink in the vicinity of the nozzle opening is increased, leading to a risk that unstable ejection will be caused due to the thickened ink. In addition, there is a disadvantage that further drying of the ink causes clogging of the nozzle opening.

In the case where there are ink droplets and ink mist adhered to a nozzle plate, they are dried by the heat and the viscosity of the adhered ink is thereby increased. Furthermore, dust is adhered to the ink, so that the ink is adhered as a foreign object in the vicinity of the nozzle opening, resulting in disadvantages such as clogging of the nozzle opening and defective liquid ejection, that is, it is difficult to eject an ink droplet in a predetermined direction when ejection has started.

Furthermore, in cases where the ink jet recording head is heated, an adhesive adhering to each member configuring the ink jet recording head is degraded due to variation in the coefficient of thermal expansion of each member, or the heat helps a solvent contained in ink to degrade of a component of the recording head and the adhesive. Consequently, there is a disadvantage that durability of the ink jet recording head is decreased.

Such disadvantages are not limited to ink jet recording apparatuses, but similarly exist in liquid ejecting apparatuses for ejecting liquids other than ink.

SUMMARY

An advantage of some aspects of the invention is that it provides a liquid ejecting apparatus for which it is possible to decrease the occurrence of defective liquid ejection and improve the durability of a recording head without decreasing print quality.

According to an aspect of the invention, there is provided a liquid ejecting apparatus including: a liquid ejecting head having a nozzle opening for ejecting a liquid; a heating unit disposed opposite a liquid ejecting surface of the liquid ejecting head; a transporting unit that transports a liquid-ejection-target medium between the liquid ejecting head and the heating unit; and a blower unit that blows air onto a surface of the liquid-ejection-target medium. The blower unit is provided so as to be able to vary an amount of air blown in a plurality of regions disposed along a certain direction, the plurality of regions including a region of the liquid-ejection-target medium. Furthermore, the liquid ejecting apparatus has a blowing control unit that controls an amount of the air blown from the blower unit in the plurality of the regions disposed along the certain direction on the basis of a width of the medium in the certain direction. In the aspect, the control of an amount of the air blown from the blower unit in the certain direction of the liquid-ejection-target medium leads to decreasing a temperature at which a predetermined liquid ejecting head is heated, so that it is possible to suppress defective liquid ejection and the decrease of the durability of the liquid ejecting head due to the application of heat to the liquid ejecting head. Because it is possible to decrease a temperature at which a predetermined liquid ejecting head is heated without decreasing a temperature at which the heating unit heats the liquid-ejection-target medium, it is possible to advance drying of ejected ink with the heating unit and the blower unit, so that it is possible to improve print quality.

It is preferable that the blowing control unit controls the blower unit so as to increase an amount of air blown in a region in which the liquid-ejection-target medium does not exist, relative to an amount of the air blown in a region in which the liquid-ejection-target medium exists. By virtue of this advantage, it is possible to decrease a temperature at which the liquid ejecting head, which has tendency to increase viscosity of a liquid in the vicinity of the nozzle opening and is not used for liquid ejection, is heated.

It is preferable that the liquid ejecting apparatus has an air heating unit that heats air blown from the blower unit, and that the air heating unit is disposed in every region in which it is possible to vary an amount of the air blown from the blower unit so as to be able to vary a temperature at which air is heated, and that the temperature at which the air heating unit heats air is in inverse proportion to an amount of the air blown from the blower unit in each of the region. By virtue of this advantage, it is possible to set a temperature at which a small amount of blown air is heated so as to be high to advance drying of a liquid applied to the liquid-ejection-target medium, and it is possible to set a temperature at which a large amount of blown air is heated so as to be low to decrease a temperature at which a predetermined liquid ejecting head is heated.

It is preferable that a plurality of the nozzle openings are formed along the certain direction of the liquid-ejection-target medium. By virtue of this advantage, it is possible to decrease a temperature at which a vicinity of the nozzle opening not used for liquid ejection is heated.

It is preferable that a plurality of the liquid ejecting heads are disposed along the certain direction of the liquid-ejection-target medium. By virtue of this advantage, it is possible to perform printing all over a broad range in a short time in a certain direction of the liquid-ejection-target medium without enlarging size of the liquid ejecting head itself. Furthermore, it is possible to decrease a temperature at which the liquid ejecting head not used for liquid ejection is heated.

It is preferable that the certain direction of the liquid-ejection-target medium is a direction intersecting a direction of relative movement between the liquid ejecting head and the liquid-ejection-target medium. By virtue of this advantage, it is possible to decrease a temperature at which a vicinity of the nozzle opening not used for liquid ejection is heated in a direction intersecting the direction of the relative movement between the liquid ejecting head and the liquid-ejection-target medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail on the basis of embodiments hereinafter.

First Embodiment

Figure 1:
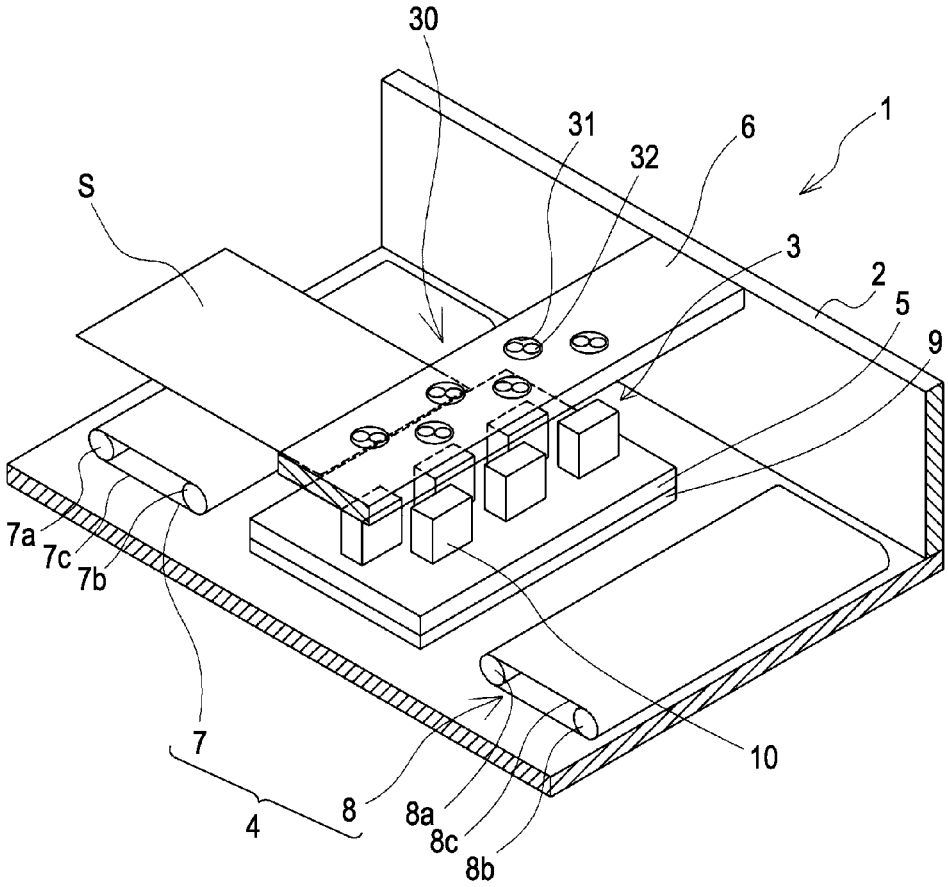
FIG. 1 is a perspective view schematically illustrating a recording apparatus according to a first embodiment of the invention.
Figure 2:
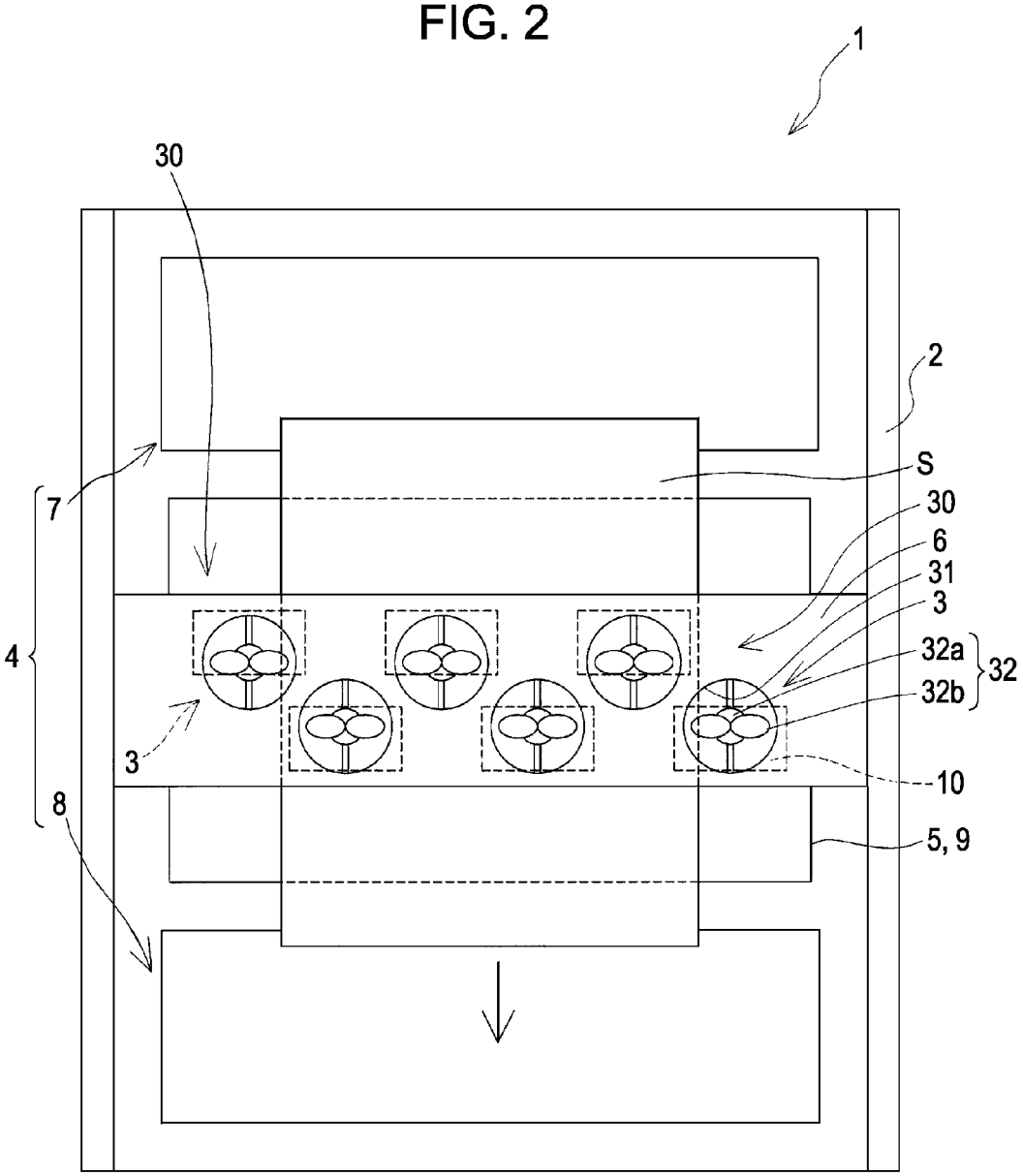
FIG. 2 is a top view of the recording apparatus according to the first embodiment of the invention.
Figure 3A:
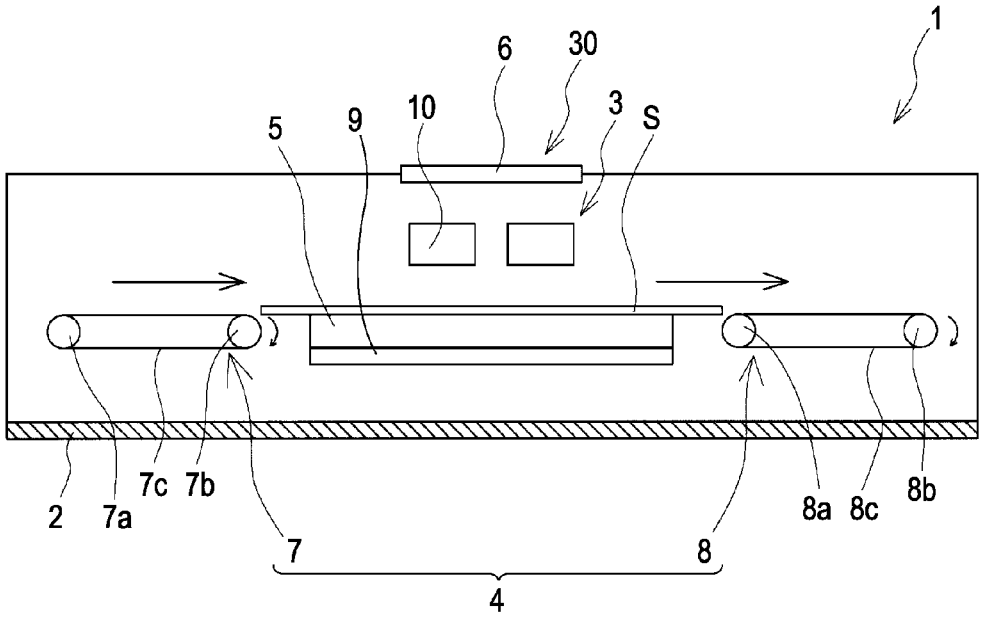
FIG. 3A is a cross sectional view illustrating the recording apparatus according to the first embodiment of the invention.
Figure 3B:
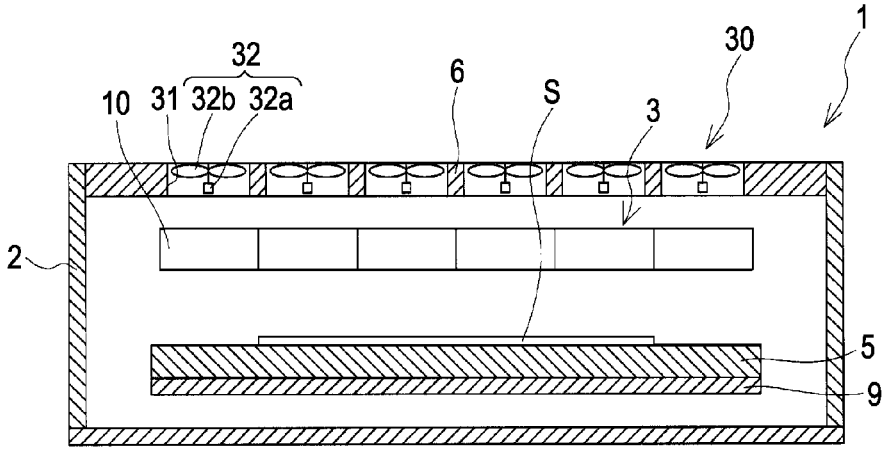
FIG. 3B is a cross sectional view illustrating the recording apparatus according to the first embodiment of the invention.

FIG. 1 is a perspective view schematically illustrating an ink jet recording apparatus as an example of a liquid ejecting apparatus according to a first embodiment of the invention. FIG. 2 is a top view illustrating the ink jet recording apparatus. FIG. 3A is a cross sectional view illustrating the ink jet recording apparatus in a transport direction of a recording medium. FIG. 3B is a cross sectional view illustrating the ink jet recording apparatus in a direction intersecting the transport direction of a recording medium.

As shown in the figures, an ink jet recording apparatus 1 as an example of a liquid ejecting apparatus of the embodiment is a so-called line recording apparatus in which an ink jet recording head is fixed therein and a recording sheet S such as paper as a liquid-ejection-target medium is transported to perform printing. Specifically, the ink jet recording apparatus 1 includes a body 2, a plurality of ink jet recording heads 10, a head unit 3 fixed to the body 2, a transport unit 4 for transporting the recording sheet S, and a supporting section 5.

In the head unit 3, a plurality of the ink jet recording heads 10 are disposed in a direction intersecting a transport direction of the recording sheet S. The ink jet recording head 10, which will be described in detail hereinafter, is provided with a single or multiple nozzle lines in which a plurality of nozzle openings are disposed in parallel. The ink jet recording head 10 is disposed in a direction intersecting a transport direction of the recording sheet S such that the nozzle openings are disposed in parallel. In addition, the plurality of the ink jet recording heads 10 are disposed in parallel in a direction intersecting the transport direction of the recording sheet S and disposed at positions slightly displaced from one another in the transport direction of the recording sheet S. In other words, the plurality of the ink jet recording heads 10 are disposed in a staggered configuration in the direction intersecting the transport direction of the recording sheet S. Each of the adjacent ink jet recording heads 10 is disposed such that the nozzle opening at an end of the nozzle line of one ink jet recording head 10 is aligned with the nozzle opening at an end of the nozzle line of another ink jet recording head 10 in the transport direction of the recording sheet S. Consequently, it is possible to perform printing over an entire range across a width direction of the recording sheet S intersecting the transport direction thereof. In the embodiment, the head unit 3 is provided with six ink jet recording heads 10. In addition, in the embodiment, although a holding member for holding the ink jet recording head 10 is not specifically shown in the figures, the ink jet recording head 10 may be fixed to a holding section 6 of a blower unit 30 which will be described hereinafter, or may be provided with a holding section other than the holding section 6 of the blower unit 30.

In addition, each ink jet recording head 10 of the head unit 3 is connected to an ink storage unit (not shown), such as an ink tank, and an ink cartridge in which ink is stored so as to be able to supply the ink. For example, the ink storage unit may be held in the head unit 3 or may be held at a position which is different from a position at which the head unit 3 is disposed in the body 2.

The transport unit 4 includes a first transport unit 7 and a second transport unit 8, each separately disposed at the two ends of the body 2 in the transport direction of the recording sheet S relative to the head unit 3.

The first transport unit 7 includes a driving roller 7*a*, a driven roller 7*b*, and a transport belt 7*c* looped around the driving roller 7*a* and the driven roller 7*b*. The second transport unit 8 includes a driving roller 8*a*, a driven roller 8*b*, and a transport belt 8*c* similarly to the first transport unit 7.

A driving unit (not shown) such as a driving motor is connected to the respective driving rollers 7*a* and 8*a* of the first transport unit 7 and the second transport unit 8. The transport belts 7*c* and 8*c* are rotationally driven by driving force of the driving unit, so that the recording sheet S is transported to the upstream side or the downstream side of the head unit 3.

In the embodiment, although the first transport unit 7 and the second transport unit 8 respectively including the driving rollers 7*a* and 8*a*, the driven rollers 7*b* an 8*b*, and transport belts 7*c* and 8*c* are described as an example, a holding unit that holds the recording sheet S on the transport belts 7*c* and 8*c* may be additionally provided. For example, a charging unit that changes a peripheral surface of the recording sheet S may be provided as the holding unit to attract the recording sheet S charged by the charging unit onto the transport belts 7*c* and 8*c* by using the effect of dielectric polarization. In addition, a retaining roller may be provided as the holding unit on the transport belts 7*c* and 8*c* to pinch the recording sheet S between the retaining roller and the transport belts 7*c* and 8*c*.

The supporting section 5 is provided between the first transport unit 7 and the second transport unit 8 while facing the head unit 3, and is made from metal or resin having a rectangular-shaped cross section. The supporting section 5 supports the recording sheet S transported with the first transport unit 7 and the second transport unit 8 at a position opposite the head unit 3.

The supporting section 5 may be provided with an attracting unit that attracts the transported recording paper S onto the supporting section 5. For example, examples of the attracting unit include a unit for suctioning the recording paper S to attract the recording paper S and include a unit for electrostatically attracting the recording sheet S by electrostatic force.

Furthermore, the supporting section 5 of the embodiment is provided with the heating unit 9. In the embodiment, the supporting section 5 is provided with the heating unit 9 on a surface thereof at the back of a surface facing the ink jet recording head 10 while using a thermally-conductive material as the supporting section 5. For example, it is possible to use an infrared lamp or an electrothermal heater as the heating unit 9.

Moreover, the ink jet recording apparatus 1 is provided with the blower unit 30 for blowing air onto a surface of the recording sheet S to which the ink jet recording head 10 applies ink. The blower unit 30 includes a holding section 6 fixed to the body 2 so as to face the supporting section 5 of the ink jet recording head 10, a plurality of blowing holes 31 formed in the holding section 6, and a blowing device 32 disposed in each blowing hole 31.

The holding section 6 has a length in a direction in which a plurality of the ink jet recording heads 10 are disposed. Namely, in the embodiment, the direction is the width direction of the recording sheet S intersecting the transport direction thereof, and it corresponds to a certain direction in an aspect of the invention.

The blowing holes 31 are formed in the holding section 6 such that the holding section 6 is penetrated in a thickness direction to a surface not facing the ink jet recording head 10. In addition, the blowing device 32 disposed in each of the blowing holes 31 includes a driving motor 32*a* (see FIG. 2) fixed to inside of the blowing hole 31 and a vane 32*b* fixed to a rotating shaft of the driving motor 32*a*.

In the blower unit 30 having such a configuration, the driving motor 32*a* is driven in the blowing hole 31 to rotate the vane 32*b*, and thereby air is blown from the blowing hole 31 on to a liquid-ejection-target surface of the recording sheet S.

In the embodiment, the holding section 6 is provided with six blowing holes 31 along a direction intersecting the transport direction of the recording sheet S (corresponding to a certain direction in an aspect of the invention). Furthermore, each of the blowing holes 31 is formed so as to correspond to one of the ink jet recording heads 10. Namely, the blowing holes 31 are formed in parallel in a direction intersecting the transport direction of the recording sheet S, and disposed at positions slightly displaced from one another in the transport direction of the recording sheet S.

In the blower unit 30 including a plurality of blowing holes 31 provided with the blowing devices 32 therein, driving of each blowing device 32 is controlled, so that it is possible to vary an amount of air blown in a plurality of regions along a certain direction (in the embodiment, the width direction of the recording sheet S intersecting the transport direction thereof), the regions including a liquid-ejection-target region of the recording sheet S. In order to control the driving of each blowing device 32 to vary an amount of air blown, the rotating speed of the driving motor 32*a* is changed. The liquid-ejection-target region of the recording sheet S is a printing region of the recording sheet S on which printing is performed with the plurality of the ink jet recording heads 10, and, in the embodiment, it is a region that extends in the width direction of the recording sheet S intersecting the transport direction thereof.

Figure 4:
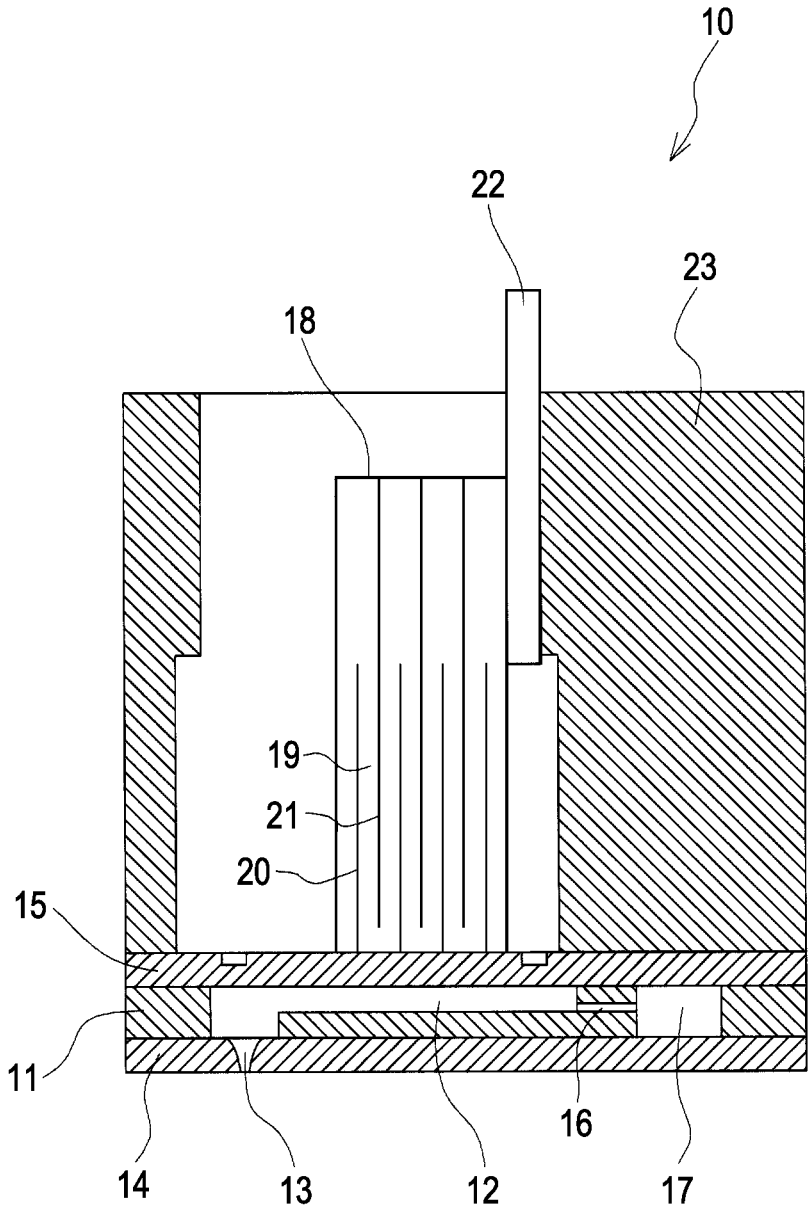
FIG. 4 is a cross sectional view illustrating a recording head according to the first embodiment of the invention.

The ink jet recording head 10 with which the above ink jet recording apparatus 1 is provided will be described hereinafter. FIG. 4 is a cross sectional view illustrating an example of the ink jet recording head according to the first embodiment of the invention.

The ink jet recording head 10 shown in FIG. 4 is a recording head having longitudinal vibration type piezoelectric devices. A plurality of pressure generating chambers 12 is provided in parallel in a spacer 11. The spacer 11 is disposed between a nozzle plate 14 and a vibrating plate 15 to be sealed, the nozzle plate 14 having nozzle openings 13 corresponding to respective pressure generating chambers 12. A reservoir 17 is formed in the spacer 11, the reservoir 17 being in communication with each of the pressure generating chambers 12 through respective ink supply ports 16 so as to be a common ink chamber of a plurality of pressure generating chambers 12. The reservoir 17 is connected to an ink cartridge (not shown).

On the other hand, piezoelectric devices 18 are provided such that an end of each piezoelectric device 18 abuts on a surface of the vibrating plate 15 not facing the pressure generating chamber 12 in a region corresponding to one of the pressure generating chambers 12. In each piezoelectric device 18, a piezoelectric material 19 and electrode forming materials 20 and 21 are alternately stacked such that the piezoelectric material 19 is sandwiched between the electrode forming materials 20 and 21, and an inactive region not contributing to vibration is fixed to a fixed substrate 22. In addition, the fixed substrate 22, the vibrating plate 15, the spacer 11, and the nozzle plate 14 are integrally fixed using a base 23.

In the ink jet recording head 10 having such a configuration, the reservoir 17 is supplied with ink through an ink channel in communication with the ink storage unit, and then the ink is distributed to each of the pressure generating chambers 12 though the respective ink supply ports 16. In practice, a voltage is applied to the piezoelectric device 18 to contract the piezoelectric device 18. Accordingly, the vibrating plate 15 is changed in conjunction with the contraction of the piezoelectric device (moved in an upper direction in the figure) to increase volume of the pressure generating chamber 12, so that the ink is drawn into the pressure generating chamber 12. The pressure generating chamber 12 is filled with the ink until the ink reaches the nozzle opening 13, and then a voltage applied to the electrode forming materials 20 and 21 of the piezoelectric device 18 is turned off in accordance with a recording signal from a driving circuit, and then the contracted piezoelectric device 18 expands to return to the original state thereof. Consequently, because the vibrating plate 15 is also displaced to return to the original state thereof, the pressure generating chamber 12 is contracted, so that inner pressure is increased to eject an ink droplet from the nozzle opening 13. Namely, in the embodiment, a vibration type of piezoelectric device 18 is provided as a pressure generating unit for generating a pressure change in the pressure generating chamber 12.

In cases where the above ink jet recording apparatus 1 performs black-and-white printing with a single color of ink, the ink jet recording head 10 is disposed in the head unit 3 in the width direction of the recording sheet S. In cases where, for example, the ink jet recording apparatus 1 performs color printing with multiple colors of ink, a recording head which is integrally provided with a plurality of the ink jet recording heads 10 shown in FIG. 4 may be used as an ink jet recording head which is mounted in the head unit 3.

Figure 5:
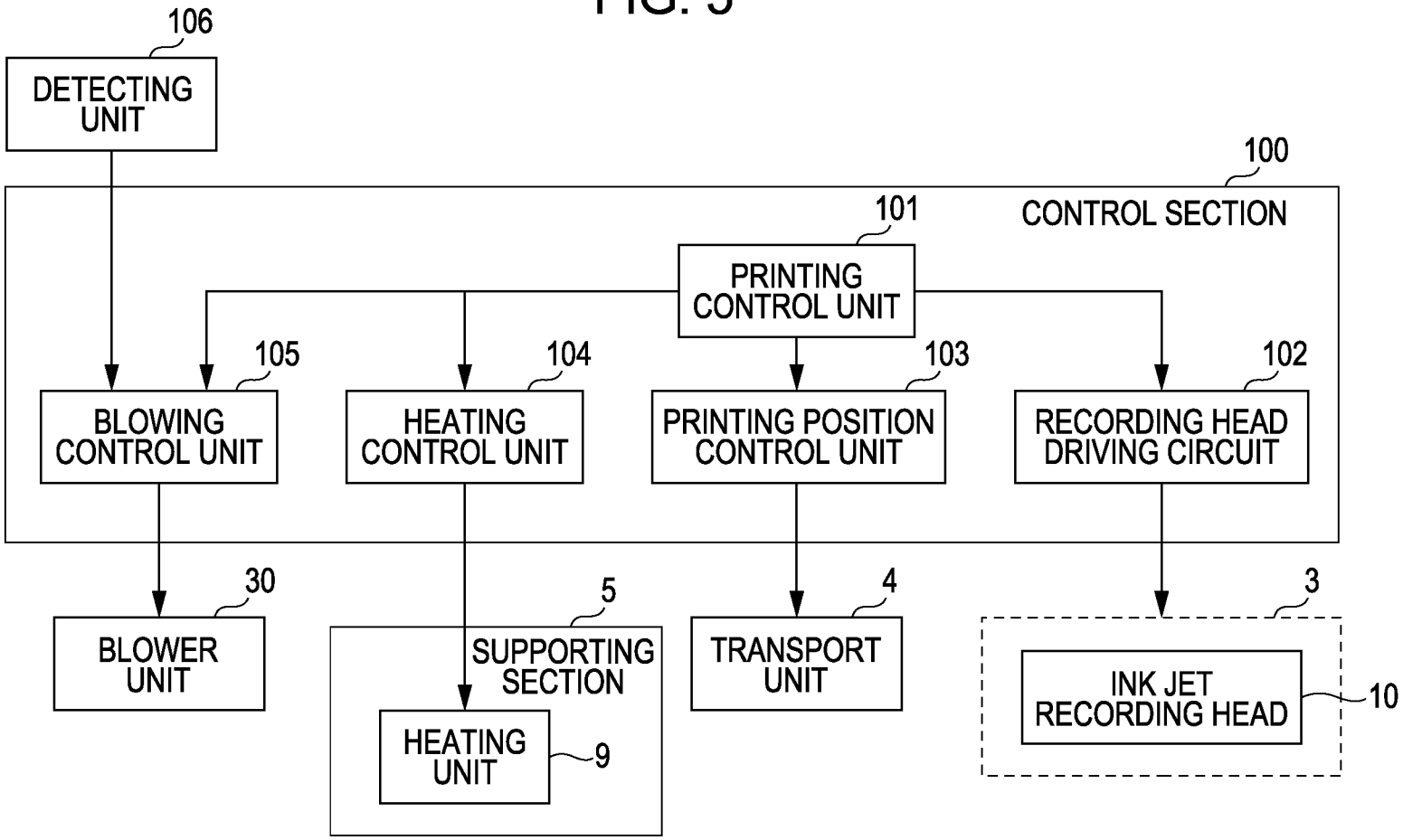
FIG. 5 is a block diagram illustrating a configuration for controlling the recording apparatus according to the first embodiment of the invention.

A configuration for controlling the ink jet recording apparatus 1 having such a configuration will be described hereinafter. FIG. 5 is a block diagram illustrating a configuration for controlling the ink jet recording apparatus 1.

With reference to FIG. 5, the ink jet recording apparatus 1 includes a control section 100 for controlling the operation of the head unit 3 having the ink jet recording head 10 which is a mechanism that actually performs printing, the transport unit 4 for transporting the recording sheet S, the heating unit 9, the blower unit 30, and the ink jet recording head 10.

The control section 100 has a printing control unit 101, a recording head driving circuit 102, a printing position control unit 103, a heating control unit 104, and a blowing control unit 105.

The printing control unit 101 controls the printing operation of the ink jet recording head 10. For example, after the input of a print signal, a driving pulse is applied to the piezoelectric device 18 through the recording head driving circuit 102 with the result that the ink jet recording head 10 ejects ink.

The printing position control unit 103 positions the recording sheet S during the printing operation of the ink jet recording head 10. In other words, the printing position control unit 103 controls an amount by which the transportation unit 4 transports the recording sheet S to a region facing the ink jet recording head 10, so that the recording sheet S is positioned in the transport direction relative to the ink jet recording head 10.

In addition, the ink jet recording apparatus 1 is provided with a detecting unit 106. The detecting unit 106 detects a liquid-ejection-target region of the recording sheet S (printing region in the embodiment). In the embodiment, a width of the recording sheet S in a direction intersecting the transport direction of the recording sheet S is detected as the liquid-ejection-target region. For example, an optical sensor for measuring a width of the recording sheet S is used as the detecting unit 106. In addition, the detecting unit 106 is not limited to the optical sensor, and for example, a guide may be provided in a paper cartridge for retaining the recording sheet S therein to adjust a width of the recording sheet S, and the detecting unit 106 may mechanically detect a position of the guide. Users of the ink jet recording apparatus 1 may manually input a width of the recording sheet S without the detecting unit 106 being provided. Furthermore, the control section 100 may retain a size of the recording sheet S on which printing is performed and a printable region subjected to liquid ejection of the recording sheet S except for a white space or the like, and the liquid-ejection-target region may be defined on the basis of externally input print data.

The heating control unit 104 controls the heating unit 9 during the printing operation of the ink jet recording head 10 to heat the supporting section 5, so that the recording sheet S supported by the supporting member 5 is heated. In addition, the heating control unit 104 controls the heating unit 9 to stop heating the supporting member 5 during idle periods in which printing is not performed or in cases where the supporting member 5 is at a predetermined temperature or higher. Meanwhile, it is possible to monitor a temperature of the supporting section 5 with a temperature sensor or the like.

The blowing control unit 105 controls the blower unit 30 on the basis of the width direction of the recording sheet S intersecting the transport direction thereof, the width direction being detected with the detecting unit 106.

The blowing control unit 105 controls the blower unit 30, so that the blowing devices 32 blow air in a region facing the recording sheet S. Namely, such blowing devices 32 face a printing region (liquid-ejection-target region) in which printing is actually performed. In addition, an amount of air blown from the blowing devices 32 facing a region in which the recording sheet S does not exist is increased relative to an amount of air blown from the blowing devices 32 facing a printing region. Namely, an amount of the air blown from the blower unit 30 is varied in the width direction of the recording sheet S intersecting the transport direction thereof.

Figure 6A:
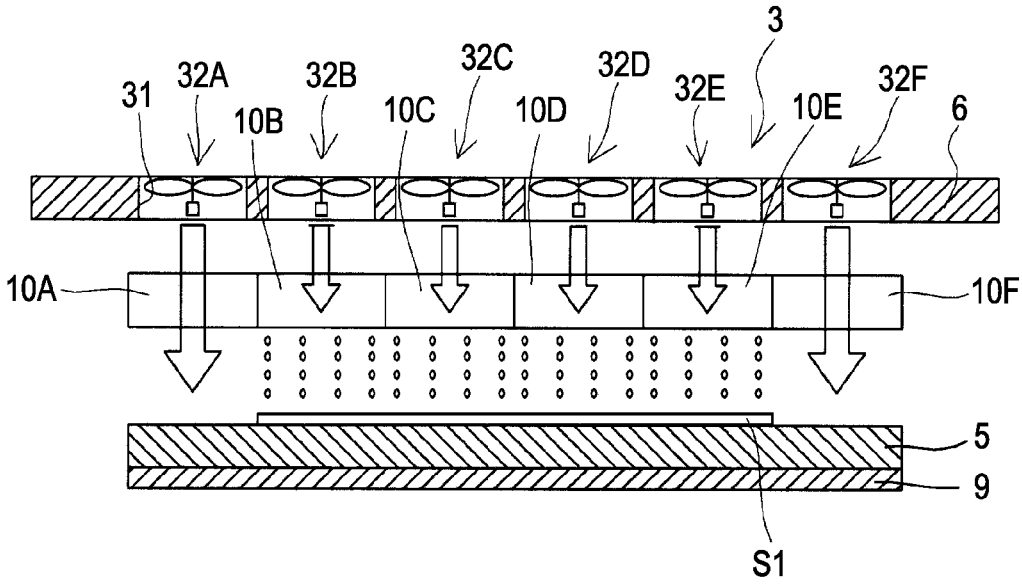
FIG. 6A is a cross sectional view illustrating blowing operation according to the first embodiment of the invention.

Specifically, with reference to FIG. 6A, the blowing control unit 105 increases an amount of air blown from the blowing devices 32A and 32F facing a region in which a recording sheet S1, on which printing is performed, does not exist relative to an amount of air blown from the blowing devices 32B to 32E facing a region in which the recording sheet S1 exists. In the case of an example shown in FIG. 6A, because the recording sheet S1 faces four ink jet recording heads 10B to 10E among six ink jet recording heads 10A to 10F, the ink jet recording heads 10A and 10F at both ends of the six recording heads are not used for the recording sheet S1. Consequently, an amount of the air blown from the blowing devices 32A and 32F, which are disposed in a region in which the recording sheet S1 does not exist, is increased relative to an amount of the air blown from other blowing devices 32B to 32E such that a temperature at which the heating unit 9 applies heat to the ink jet recording heads 10A and 10F, which are not used for printing on the recording sheet S1 and do not eject ink droplets, is decreased.

Figure 6B:
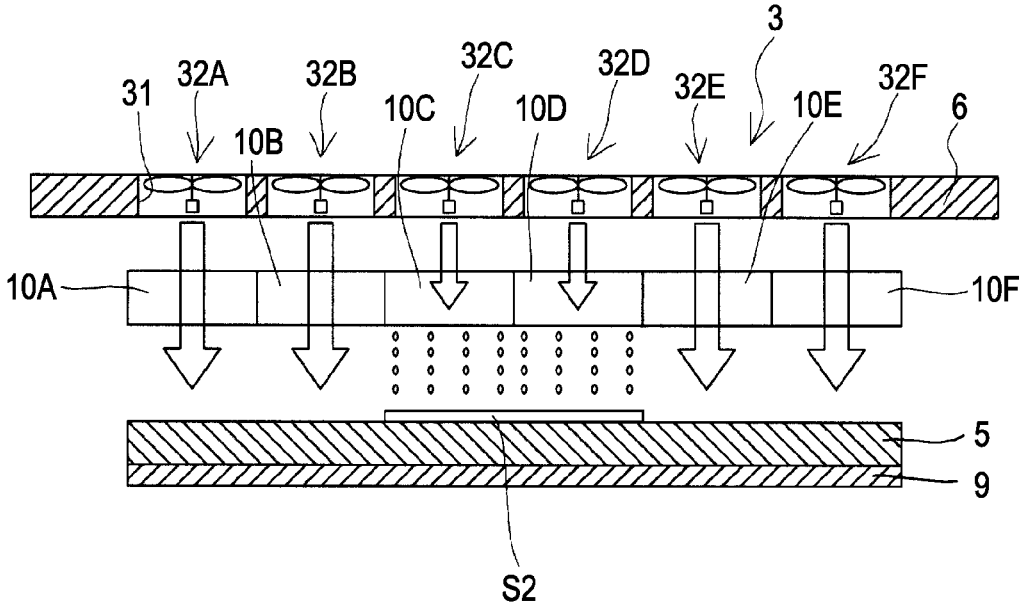
FIG. 6B is a cross sectional view illustrating the blowing operation according to the first embodiment of the invention.

In cases where a width of a recording sheet S2, on which printing is performed, is smaller than that of the recording sheet S1 as shown in FIG. 6B, the blowing control unit 105 similarly increases an amount of air blown from the blowing devices 32A, 32B, 32E, and 32F facing a region in which the recording sheet S2 does not exist relative to an amount of air blown from the blowing devices 32C and 32D facing a region in which the recording sheet S2 exists. Consequently, a temperature at which the heating unit 9 applies heat to the ink jet recording heads 10A, 10B, 10E and 10F, which are not used for printing on the recording sheet S2, is decreased.

Meanwhile, in cases where the blowing device 32 facing the ink jet recording head 10 not used for printing blows air, the ink jet recording head 10 not used for printing is directly cooled due to blown air. In addition, it is possible to cool a region of the supporting section 5 in which the recording sheet S does not exist by the air blown from the blower unit 30, so that it is possible to decrease temperature of a region of the supporting section 5 in which the recording sheet S does not exist, the supporting section 5 being heated with the heating unit 9. Namely, although the supporting section 5 is entirely heated with the heating unit 9, the supporting section 5 is cooled by the air blown from the blower unit 30. In this case, the recording sheet S shields a region in which the recording sheet S exists (printing region and liquid-ejection-target region) from the blown air, and the region is less cooled relatively due to a small amount of the blown air. On the other hand, the recording sheet S does not shield a region in which the recording sheet S does not exist from the air blown from the blower unit 30, and the region is more cooled due to a large amount of the air blown from the blower unit 30. Consequently, it is possible to decrease a temperature of a region in which the recording sheet S does not exist relative to a temperature of a region in which the recording sheet S exists, the regions being part of the supporting section 5 heated by the heating unit 9. As a result, it is possible to decrease a temperature at which the ink jet recording head 10 not used for printing is heated by heat of the supporting section 5.

As described above, it is possible to decrease a temperature at which the vicinity of the nozzle opening 13 of the ink jet recording head 10 not used for printing is heated by decreasing a temperature of the supporting section 5 facing the nozzle opening 13 of the ink jet recording head 10 not used for printing. Consequently, it is possible to suppress the occurrence of a problem such as clogging of the nozzle opening 13 and variation of a position on which ink droplets land at the start of the ejection, the problem being caused by the increase of viscosity of ink in the vicinity of the nozzle opening 13 due to heating.

Furthermore, the blower unit 30 decreases a temperature at which the heating unit 9 heats the ink jet recording head 10 facing a region in which the recording sheet S does not exist, so that it is possible to suppress the decrease of the durability of the ink jet recording head 10 due to heating. Namely, in cases where the ink jet recording head 10 is heated, an adhesive or the like adhering to each member configuring the ink jet recording head 10 is adversely affected to cause a problem that the durability of the ink jet recording head 10 not used for printing is decreased. However, the suppression of heating the ink jet recording head 10 not used for printing leads to suppressing the decrease of the durability of the ink jet recording head 10. Meanwhile, because the recording sheet S shields a region in which the recording sheet S exists from heat of the heating unit 9, a temperature at which the ink jet recording head 10 is heated in such a region is lower than the ink jet recording head 10 in a region in which the recording sheet S does not exist, unless an amount of the air blown from the blower unit 30 is controlled. In addition, in the region in which the recording sheet S exists, because heat is blocked with the recording sheet S and ink droplets are ejected from the nozzle opening 13, the heated ink is ejected even though ink in the vicinity of the nozzle opening 13 is heated, and thereby nozzle clogging and variation of a position on which ink droplets land are less caused due to the increase of viscosity of ink.

Furthermore, because the blowing control unit 105 controls the blower unit 30 to only increase an amount of air blown to a non-printing region which is not a printing region (recording sheet S), it is possible to suppress the decrease of a temperature at which the heating unit 9 heats the recording sheet S. Accordingly, it is possible for the heating unit 9 to desirably heat the recording sheet S (ink applied to the recording sheet S, in other words). In cases where the heating unit 9 heats the ink applied to the recording sheet S, a component of ink is volatilized and then remains, and thereby it takes a long time to dry the ink. However, the blower unit 30 blows air to a printing region (liquid-ejection-target region), so that it is possible to remove the component volatilized from the ink to advance drying of the ink.

Meanwhile, it may be proposed that a heating unit for heating the recording sheet S is divided in a certain direction (in the embodiment, the width direction of the recording sheet S intersecting the transport direction thereof) and that the divided heating unit is individually controlled to partially change a temperature at which the recording sheet S is heated. However, even though the heating unit is divided, it is difficult to partially control a supporting member so as to be at a desired temperature due to low thermal-reactivity of the supporting section 5. On the other hand, in the invention, it is possible to employ a suction unit to prevent only the ink jet recording head 10 not used for printing from being unnecessarily heated.

In the above example, it is illustrated that width of the recording sheets S1 and the S2 is aligned with any of boundaries of the individual ink jet recording heads 10A to 10F. In addition, the suction unit is provided in a direction intersecting the transport direction of the recording sheets S1 and the S2 in the same numbers as those of the ink jet recording heads 10. Consequently, it is configured so as to control an amount of air blown from any of the blowing devices 32A to 32F being in a region in which the recording sheet S1 or S2 does not exist. However, the invention is not limited to such an example.

For example, in cases where an edge of the recording sheet S in the width direction is below the blowing device 32B, only an amount of air blown from the blowing device 32A may be increased. In this case, the nozzle openings 13 of the ink jet recording head 10B have both the nozzle opening 13 used for printing and the nozzle opening 13 not used for printing. Because the nozzle opening 13 not used for printing is on the side of the blowing device 32A blowing a large amount of air, heating temperature is decreased in the vicinity of the nozzle opening 13 not used for printing. The number of the blowing devices 32 may not be the same as that of the ink jet recording head 10 in a certain direction (a direction intersecting the transport direction of the recording sheet S).

Furthermore, in the embodiment, although it is configured so as to control an amount of the air blown from the blowing devices 32A to 32F of the blower unit 30 disposed in parallel in the width direction of the recording sheet S (certain direction) intersecting the transport direction thereof, it may be configured so as to provide a plurality of the blowing devices 32 also in the transport direction of the recording sheet S to control an amount of the air blown from the blowing device 32 in the transport direction of the recording sheet S, for example. Namely, an end of the recording sheet S is on the supporting section 5 in the transport direction at the start and end of printing, and a region in which the recording sheet S exists or does not exist is generated in the transport direction, so that an amount of the air blown in a region in which the recording sheet S does not exist may be increased in the transport direction relative to that in a region in which the recording sheet S exists.

Figure 7:
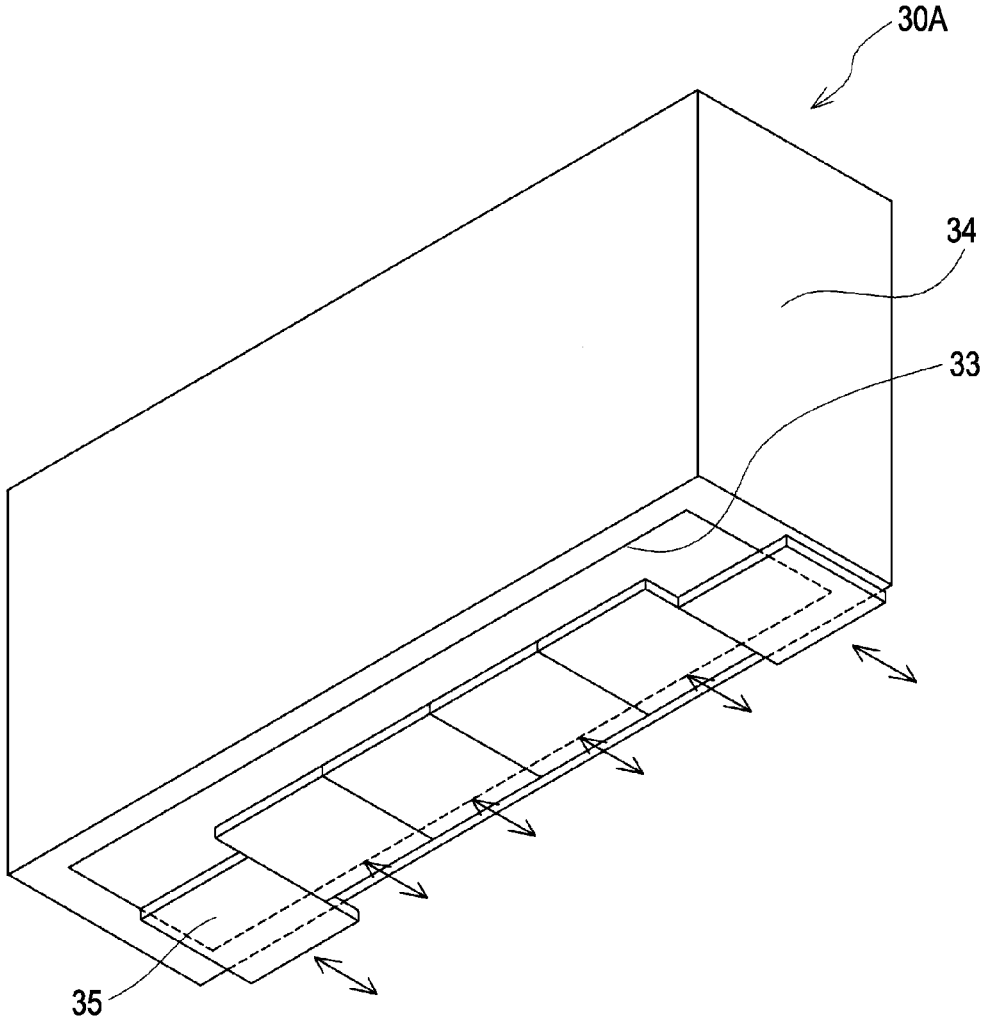
FIG. 7 is a perspective view illustrating another example of a blower unit according to the first embodiment of the invention.

Furthermore, although the embodiment illustrates the blower unit 30 having the holding section 6, a plurality of the blowing holes 31, and the blowing device 32 provided in each blowing hole 31, the invention is not specifically limited to such an example. Another example of the blower unit is illustrated in FIG. 7. FIG. 7 is a perspective view illustrating another example of the blower unit according to the first embodiment of the invention.

With reference to FIG. 7, a blower unit 30A includes a blowing device 34 provided with a blowing hole 33 formed in a length in a direction (certain direction) in which the ink jet recording heads 10 (not shown) are disposed in parallel, and a shielding plate 35 that shields the blowing hole 33 of the blowing device 34.

A plurality of the shielding plates 35 are provided in a direction in which the ink jet recording heads 10 are disposed in parallel. The individual shielding plates 35 are operatively provided so as to adjust an open surface area of the blowing hole 33. The blowing device 34 may be a blowing pump or the like that blows air through the blowing hole 33.

It is also possible to control an amount of air blown with the blower unit 30A having such a configuration in a region in which the recording sheet S exists or does not exist.

Second Embodiment

Figure 8:
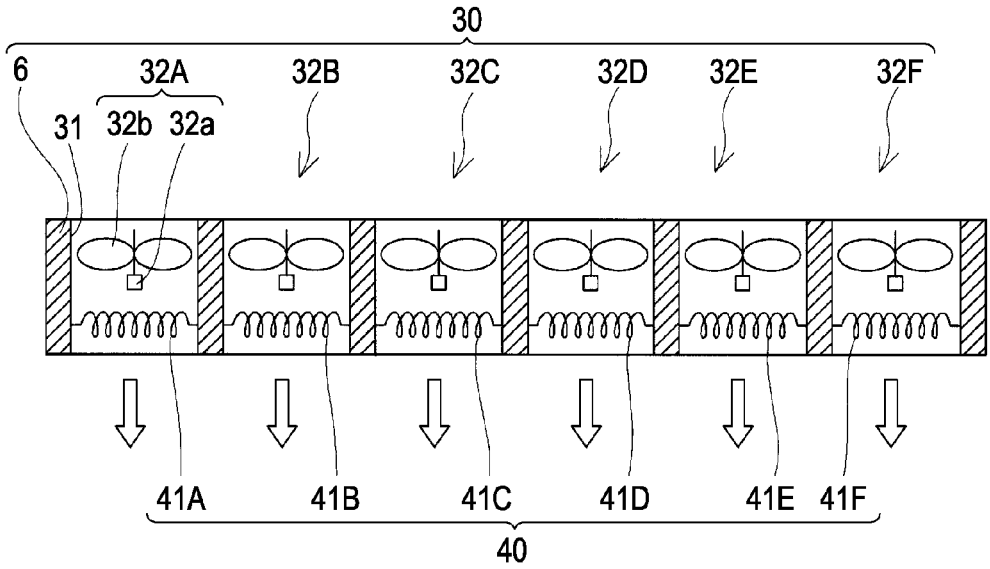
FIG. 8 is a cross sectional view illustrating a blower unit and an air heating unit according to a second embodiment of the invention.

FIG. 8 is a cross sectional view illustrating a blower unit and an air heating unit according to a second embodiment of the invention. In addition, the same member as the first embodiment is denoted by the same number, and repetitive description is omitted.

With reference to FIG. 8, in the embodiment, the blower unit 30 is provided with an air heating unit 40 that heats air blown from the blower unit 30. Specifically, heating sections 41A to 41F as the air heating unit 40 are individually provided in each of the blowing holes 31 of the holding section 6.

The individual heating sections 41A to 41F are disposed below each blowing device 32A to 32F in the individual blowing holes 31. Air blown from the blowing devices 32A to 32F respectively contacts the heating sections 41A to 41F, so that the air is heated. It is possible to use an electrothermal heater as the heating sections 41A to 41F.

In the embodiment, the individual heating sections 41A to 41F as the air heating unit 40 are provided in each blowing hole 31 of the blower unit 30, so that it is possible to change a temperature of air blown from the blower unit 30 in every region in which it is possible to vary an amount of the air blown from the blower unit 30.

By virtue of this advantage, for example, the above described blowing control unit 105 of the first embodiment controls a temperature at which each heating section 41A to 41F produces heat such that the temperature is in inverse proportion to an amount of the air blown from the blowing devices 32A to 32F. Thereby, it is possible to increase a temperature of air blown to a region in which the recording sheet S exists to further advance drying of ink applied onto the recording sheet S. In addition, it is possible to decrease a temperature of air blown to a region in which the recording sheet S does not exist to cool the recording head 10 not used for printing and the supporting section 5 (a region which substantially heats the ink jet recording head 10), so that it is possible to decrease a temperature at which the recording head 10 not used for printing is heated.

Third Embodiment

Figure 9A:
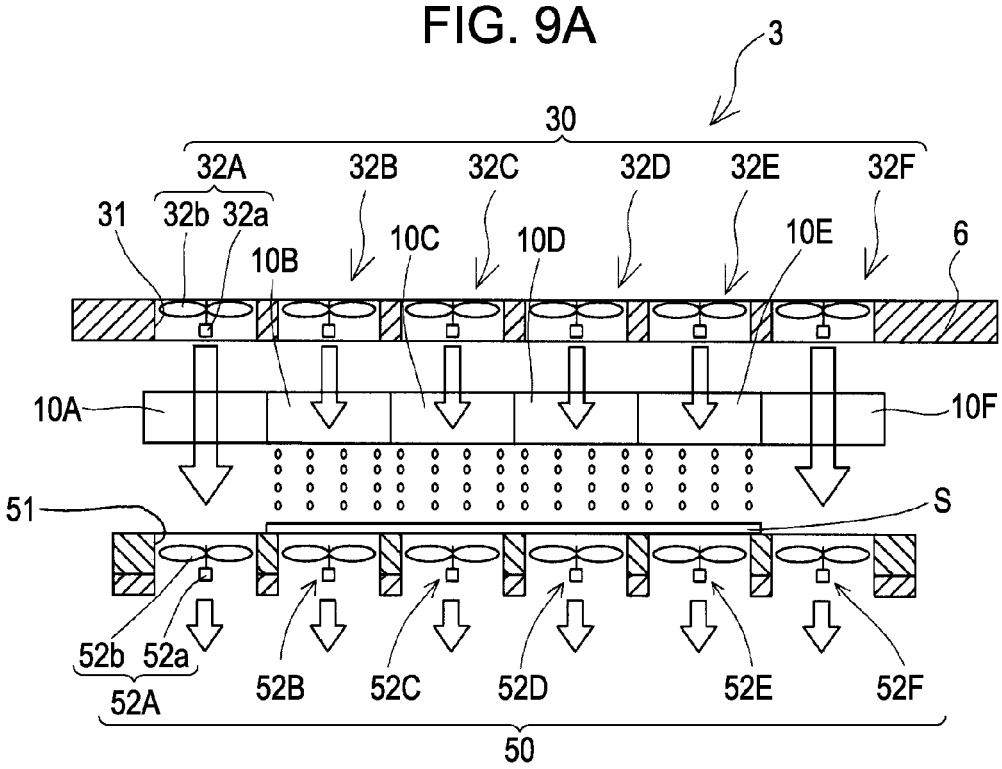
FIG. 9A is a partial cross sectional view illustrating a recording apparatus according to a third embodiment of the invention.
Figure 9B:
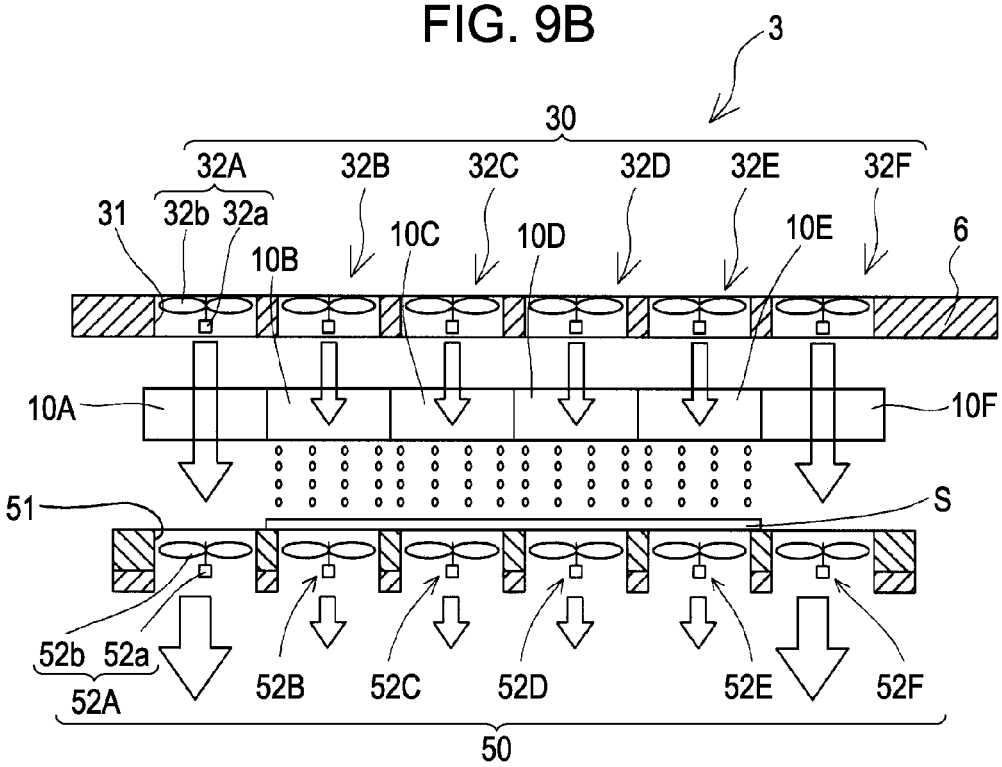
FIG. 9B is a partial cross sectional view illustrating a recording apparatus according to a third embodiment of the invention.

FIGS. 9A and 9B are partial perspective views illustrating an ink jet recording apparatus according to a third embodiment of the invention. In addition, the same member as the first embodiment is denoted by the same number, and repetitive description is omitted.

With reference to FIG. 9A, in the embodiment, a suction unit 50 is provided at a position facing liquid ejecting surfaces (surfaces on which the nozzle openings 13 are respectively formed) of the ink jet recording heads 10A to 10F, the suction unit 50 suctioning the recording sheet S in a direction opposite to the ink jet recording heads 10A to 10F.

The suctioning unit 50 of the embodiment includes a plurality of suctioning holes 51 formed on the supporting section 5, and suctioning devices 52A to 52F (hereinafter referred to as suctioning devices 52) individually provided in each of the suctioning holes 51.

The suctioning holes 51 are formed on a surface of the supporting section 5 that supports the recording sheet S such that the supporting section 5 is penetrated in a thickness direction to a surface at the back of a surface that supports the recording sheet S. In addition, the blowing device 52 provided in the suctioning hole 51 includes a driving motor 52*a* fixed to inside of the suctioning hole 51 and a vane 52*b* fixed to a rotating shaft of the driving motor 52*a*.

In the suctioning unit 50 having such a configuration including a plurality of the suctioning holes 51 and the suctioning devices 52, the driving motor 52*a* is driven in the suctioning hole 51 to rotate the vane 52*b*, so that a negative pressure is generated in the suctioning hole 51 at the side of the recording sheet S relative to the side of vane 52, and thereby the recording sheet S is attracted onto a surface of the supporting section 5.

In the embodiment, six suctioning holes 51 are formed in parallel on the supporting section 5 along a region in which it is possible to vary an amount of the air blown from the blower unit 30. Namely, the suctioning devices 52 are provided in a direction in which the ink jet recording heads 10A to 10F are provided in parallel.

The suctioning unit 50 is provided in this way, so that the recording sheet S is attracted onto the supporting section 5 to steady the recording sheet S, and thereby it is possible to perform stable printing.

Furthermore, the suctioning device 52 of the suctioning unit 50 in a region in which the recording sheet S does not exist (the suctioning devices 52A and 52F in examples shown in FIGS. 9A and 9B) also performs the suction operation, so that the suctioning unit 50 suctions the air blown from the blower unit 30 to be able to form airflow in the region in which the recording sheet S does not exist. Specifically, in the examples shown in FIGS. 9A and 9B, the suctioning device 52A suctions the air blown from the blowing device 32A to generate the airflow from the blowing device 32A to the suctioning device 52A. Similarly, the suctioning device 52F suctions air blown from the blowing device 32F to generate the airflow from the blowing device 32F to the suctioning device 52F. By virtue of such an airflow, it is possible to advance cooling of a region of the supporting section 5 in which the recording sheet S does not exist, and it is possible for the suctioning devices 52A and 52F to suction ink mist generated by ejecting ink droplets from the ink jet recording heads 10B to 10E, so that it is possible to improve print quality.

Furthermore, in the suctioning unit 50 including a plurality of suctioning holes 51 each provided with the individual suctioning devices 52 therein, driving of each suctioning device 52 is controlled to be able to change suction power in a certain direction of the recording sheet S (in the embodiment, the width direction of the recording sheet S intersecting the transport direction thereof). It is possible to control the driving of each suctioning device 52 to vary the suction power by changing the rotating speed of the driving motor 52*a*.

Accordingly, as shown in FIG. 9B, the suction power of the suctioning devices 52A and 52F of the suctioning unit 50 facing a region in which the recording sheet S does not exist is configured so as to be stronger relative to those of the suctioning devices 52B to 52E in a region in which the recording sheet S exists, so that it is possible to further decrease a temperature of the region of the supporting section 5 in which the recording sheet S does not exist, resulting in decreasing a temperature at which the ink jet recording heads 10A and 10F not used for printing are heated.

In an example shown in FIG. 9B, because the suction power is increased only in the suctioning devices 52A and 52F of the suctioning unit 50 in a region not used for printing, the suctioning devices 52B to 52E disposed in a printing region accurately attract the recording sheet S onto the supporting section 5. Consequently, it is possible to accurately steady the recording sheet S to perform highly accurate printing.

Furthermore, because the suction power of the suctioning unit 50 is increased only in a non-printing region which is not a printing region (recording sheet S), it is possible to suppress the loss of a temperature at which the heating unit 9 heats the recording sheet S in a printing region (a region which is provided with the recording sheet S). Accordingly, it is possible for the heating unit 9 to desirably heat the recording sheet S (ink applied to the recording sheet S, in other words).

Figure 10:
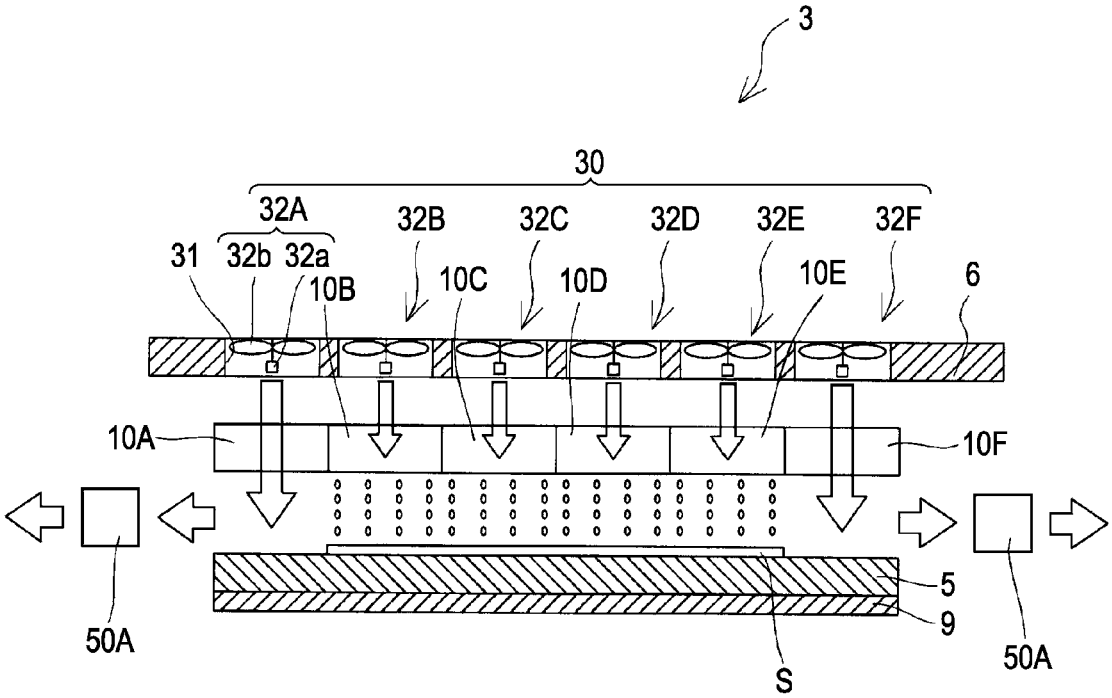
FIG. 10 is a partial cross sectional view illustrating another example of the recording apparatus according to the third embodiment of the invention.

The suctioning unit 50 is not limited to the above examples. Another example of the suctioning unit is illustrated in FIG. 10. FIG. 10 is a partial cross sectional view illustrating an ink jet recording apparatus according to a third embodiment of the invention to show another example of the suctioning unit.

With reference to FIG. 10, the suctioning unit 50A may be disposed outside a region facing the ink jet recording heads 10A to 10F at a height between the supporting member 5 and the ink jet recording heads 10A to 10F. In this case, the suctioning unit 50A may be driven so as to suction air between the supporting section 5 and the ink jet recording heads 10A to 10F.

Even though the suctioning unit 50A having such a configuration is employed, it is possible to suction the air blown from the blowing devices 32A and 32F of the blower unit 30 to cool a region of the supporting section 5 in which the recording sheet S does not exist, and it is possible to suction ink mist generated by ejecting ink droplets.

Other Embodiments

Although the embodiments of the invention have been described above, the basic configuration of the invention is not limited to the above embodiments. For example, in the first embodiment, the head unit 3 including the ink jet recording head 10 is fixed to the body 2, and the transport unit 4 transports the recording sheet S. However, because the transport unit 4 may simply enable relative movement between the ink jet recording head 10 and the recording sheet S, the recording sheet S may be fixed, and the transport unit 4 may transport the ink jet recording head 10. In this case, a transport direction is same as that in the first embodiment. In addition, a plurality of ink jet recording heads 10 may be provided also in a direction intersecting the transport direction of the recording sheet S in the above first embodiment, and printing may be performed with the ink jet recording head 10 fixed all over a liquid-ejection-target region of the recording sheet S in a state in which the recording sheet S is steadied without the recording sheet S being moved. Namely, the transport unit 4 of the first embodiment may not be substantially disposed. It is also possible to apply the invention to an ink jet recording apparatus in which the recording sheet S is transported in the transport direction to perform printing all over the printing sheet S while moving the head unit 3 in a direction (certain direction) intersecting the transport direction of the recording sheet S.

In the first embodiment, the longitudinal vibration type piezoelectric device 18 is illustrated as an example of a pressure generating unit that generates pressure variation in the pressure generating chamber 12, the device 18 being formed by alternately stacking the electrode forming material 21, the piezoelectric material 19, and the electrode forming material 20 and being expanded and contracted in a longitudinal direction. However, the invention is not specifically limited to the embodiment. For example, the invention may employ a flexural vibration type piezoelectric device configured by disposing a piezoelectric layer including a crystallized piezoelectric material between two electrodes including a lower electrode and an upper electrode, the piezoelectric device including a thin-film piezoelectric device formed by the lamination of layers through deposition or a lithographic technique and including a thick-film piezoelectric device formed by the application of green sheets. In addition, the pressure generating unit may include a unit in which a heating device is disposed in a pressure generating chamber to eject ink droplets from a nozzle opening with a bubble generated by heat produced with the heating device, and include a so-called static actuator in which static electricity is generated between a vibrating plate and an electrode to transform the vibrating plate by electrostatic force with the result that liquid droplets are ejected from a nozzle opening.

Furthermore, a target of the invention is an entire liquid ejecting apparatus including a liquid ejecting head in a broad sense. For example, it is possible to apply the invention to an image recording apparatus such as a printer, a color material ejecting apparatus used for manufacturing a color filter of a liquid crystal display or the like, an electrode material ejecting apparatus used for forming an electrode of an organic electro-luminescence (EL) display and a field emission display (FED), and a living-organic material ejecting apparatus used for manufacturing a biochip.

What is claimed is:

1. A liquid ejecting apparatus comprising:

a liquid ejecting head having a nozzle opening for ejecting a liquid;

a heating unit disposed opposite a liquid ejecting surface of the liquid ejecting head;

a transport unit that transports a liquid-ejection-target medium between the liquid ejecting head and the heating unit in a transport direction;

a detecting unit that detects a width of the liquid-ejection-target medium in a direction intersecting the transport direction;

a blower unit that blows air onto the liquid-ejection-target surface of the medium along a certain direction, the blow unit comprising a plurality of blowing devices;

a blowing control unit configured to vary an amount of air blown from each of the blowing devices of the plurality of blowing devices of the blower unit in a region facing the liquid-ejection-target medium and a region not facing the liquid-ejection-target medium in a direction intersecting the transport direction based upon the detected width of the liquid-ejection-target medium, blowing devices being disposed adjacent the region facing the liquid-ejection-target medium and the region not facing the liquid-ejection-target medium and air being blown from each of the blowing devices as the liquid-ejecting-target medium traverses past the blower unit.

2. The liquid ejecting apparatus according to claim 1, further comprising an air heating unit that heats the air blown from the blower unit, wherein the air heating unit is disposed in every region in which it is possible to vary an amount of the air blown from the blower unit so as to be able to vary a temperature at which air is heated, and the temperature at which the air heating unit heats air is in inverse proportion to an amount of the air blown from the blower unit in each of the region.

3. The liquid ejecting apparatus according to claim 1, wherein a plurality of the nozzle openings are formed along the certain direction of the liquid-ejection-target medium.

4. The liquid ejecting apparatus according to claim 1, wherein a plurality of the liquid ejecting heads are disposed along the certain direction of the liquid-ejection-target medium.

5. The liquid ejecting apparatus according to claim 1, wherein the certain direction of the liquid-ejection-target medium is a direction intersecting a direction of relative movement between the liquid ejecting head and the medium.

* * * * *